US011412827B2

(12) United States Patent
Gugubauer

(10) Patent No.: US 11,412,827 B2
(45) Date of Patent: Aug. 16, 2022

(54) APPARATUS FOR SECURED ACCOMMODATION OF DRAWING UTENSILS

(71) Applicant: Thomas Gugubauer, Edt bei Lambach (AT)

(72) Inventor: Thomas Gugubauer, Edt bei Lambach (AT)

( * ) Notice: Subject to any disclaimer, the term of this patent is extended or adjusted under 35 U.S.C. 154(b) by 0 days.

(21) Appl. No.: 17/413,778

(22) PCT Filed: Nov. 28, 2019

(86) PCT No.: PCT/AT2019/060406

§ 371 (c)(1),
(2) Date: Jun. 14, 2021

(87) PCT Pub. No.: WO2020/118325

PCT Pub. Date: Jun. 18, 2020

(65) Prior Publication Data

US 2022/0047051 A1 Feb. 17, 2022

(30) Foreign Application Priority Data

Dec. 12, 2018 (AT) ..... A 60235/2018
Mar. 20, 2019 (AT) ..... A 50240/2019

(51) Int. Cl.
*A45C 11/34* (2006.01)
*A45C 11/36* (2006.01)

(52) U.S. Cl.
CPC ..... *A45C 11/36* (2013.01); *A45C 11/34* (2013.01)

(58) Field of Classification Search
CPC ..... A45C 11/34; A45C 11/36
(Continued)

(56) References Cited

U.S. PATENT DOCUMENTS 2,967,650 A * 1/1961 Bow ..... A45C 11/36 206/315.91
4,223,820 A * 9/1980 Vorsanger ..... A45C 11/36 224/904

(Continued)

FOREIGN PATENT DOCUMENTS

AT 501 084 A1 6/2006
CN 103507501 A 1/2014

(Continued)

OTHER PUBLICATIONS

English language espacenet Abstract for EP 2 221 187 A1, Aug. 25, 2010.

(Continued)

*Primary Examiner* — Jacob K Ackun
(74) *Attorney, Agent, or Firm* — Tiajoloff & Kelly LLP

(57) ABSTRACT

An apparatus for securely accommodating drawing utensils receives one set square between two plates of a base receptacle. the plates are arranged and connected to one another such that a compartment for the set square spans between them. The compartment comprises on one side an insertion opening for the set square and, in a plate, an insertion slot for a grip piece of the set square The insertion slot originates from the insertion opening and is parallel to the insertion direction. An additional cover plate is above the triangular plate, having an insertion slot of the base receptacle for a large set square, spanning an additional compartment for drawing utensils. The cover plate is connected to the base receptacle while spanning the additional compartment. A groove-shaped pin receptacle is between the hypotenuse of the base receptacle and the nearer cover plate, and accommodates a drawing pencil clampingly on the flank side. The pin receptacle comprises a T-groove which extends longitudinally and receives a two-limbed clamping spring, (Continued)

Figure 1:
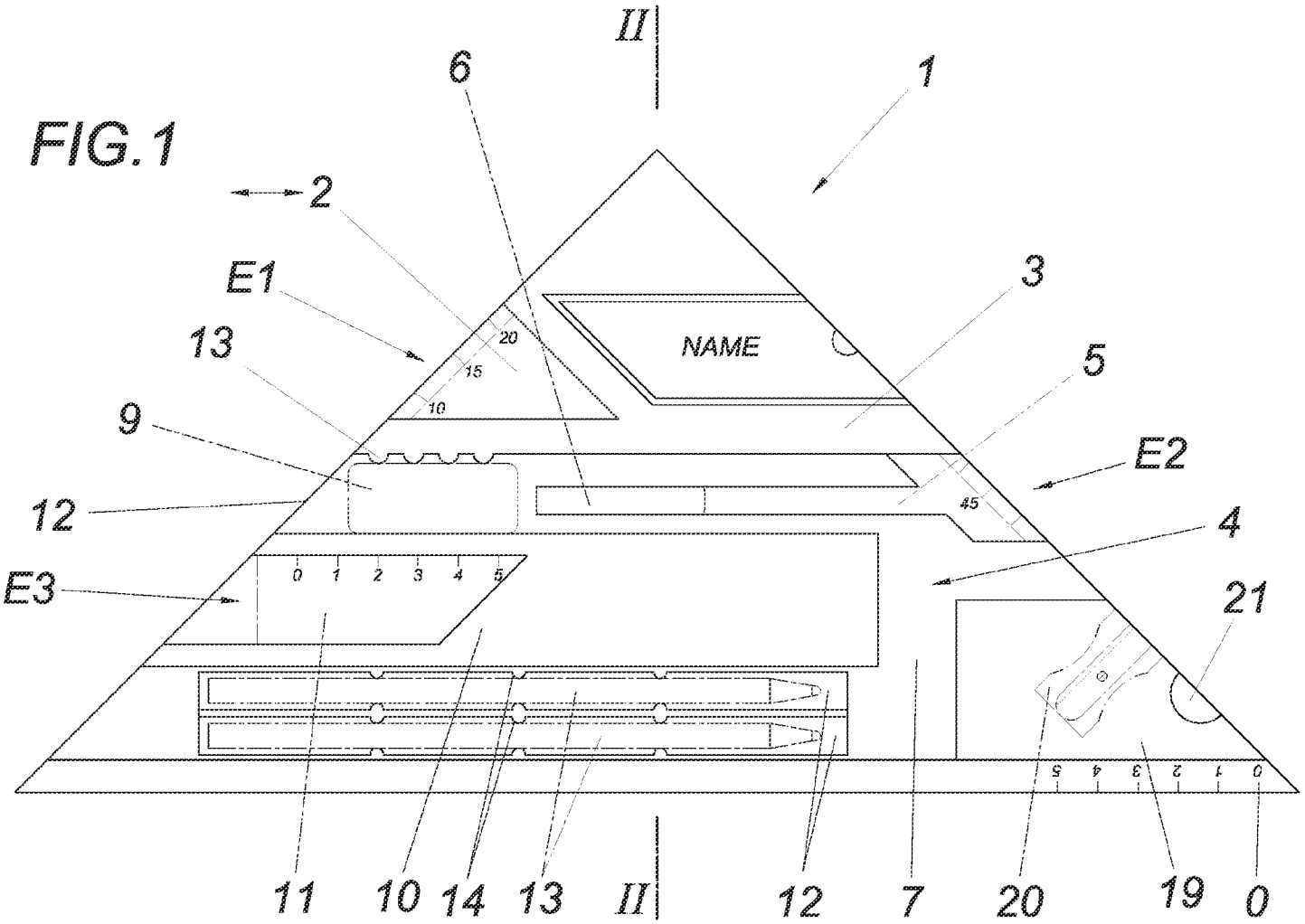

which forms a pencil holder for a drawing pencil and protrudes from a guide plate inserted into the T-groove.

13 Claims, 3 Drawing Sheets

(58) Field of Classification Search
USPC ..... 206/214, 371
See application file for complete search history.

(56) References Cited

U.S. PATENT DOCUMENTS

| | | | | |
|---|---|---|---|---|
| 5,016,796 | A * | 5/1991 | Johnson | A45F 5/02 224/678 |
| 5,036,973 | A * | 8/1991 | Aida | B42D 5/006 281/31 |
| 5,671,951 | A * | 9/1997 | Palmiter | B42D 3/12 281/31 |
| 10,897,972 | B2 * | 1/2021 | Pagan | A45C 15/06 |
| 2021/0361046 | A1 * | 11/2021 | Jeon | A45C 13/02 |

FOREIGN PATENT DOCUMENTS

| | | | |
|---|---|---|---|
| DE | 20 2004 013 993 | U1 | 12/2004 |
| DE | 20 2013 103 074 | U1 | 10/2013 |
| EP | 2 221 087 | A1 | 8/2010 |
| GB | 2 155 406 | A | 9/1985 |

OTHER PUBLICATIONS

English language espacenet Abstract for CN103507501 (A) Jan. 15, 2014.

* cited by examiner

APPARATUS FOR SECURED ACCOMMODATION OF DRAWING UTENSILS

TECHNICAL FIELD

The invention relates to an apparatus for securely accommodating drawing utensils, which receives at least one set square between two plates of a base receptacle, wherein the plates are arranged relative to one another and connected to one another in such a way that a compartment for the set square is spanned between them, wherein the compartment comprises on one side an insertion opening for the set square and, in a plate, an insertion slot for a grip piece of the set square, said insertion slot originating from the insertion opening and being parallel to the insertion direction, and wherein, above the triangular plate, having the insertion slot, of the base receptacle for a large set square, at least one additional cover plate is arranged, spanning an additional compartment for drawing utensils, which cover plate is connected to the base receptacle while spanning the additional compartment.

STATE OF THE ART

Such an apparatus is known, for example, from DE 202013103074 U1. An apparatus for holding rectangular rulers is disclosed in AT 501084 A1. Other generic apparatuses are shown in GB 2155406 A, which discloses a receptacle for an eraser, a sharpener and two pencils, CN 103507501 A and DE202004013993 U1.

Such apparatuses are made of plastic, wood or metal, for example aluminium, and have a high torsional stiffness, whereby set squares and/or rulers can be protected against mechanical damage. The apparatuses are intended to allow break-proof transport of the rulers in school bags. Known protective covers have a triangular shape and can be equipped with a graduation at the hypotenuse and can thus themselves be used as a measuring tool or as a shifting aid for set squares.

DESCRIPTION OF THE INVENTION

The invention is thus based on the task of accommodating at least two triangles, a ruler and, where appropriate, drawing pencils, sharpeners and erasers in a secured and space-saving manner, in order to protect them from damage or breakage. The term "ruler" is also understood to include font templates. It should be possible to securely hold drawing pencils in a variety of different dimensions and with different cross-sections in the apparatus.

The invention solves the problem in that at least one groove-shaped pin receptacle is provided between the hypotenuse of the base receptacle and the nearer cover plate, which pin receptacle is designed in such a manner in that it accommodates a drawing pencil in a clamping manner on the flank side, and in that the pin receptacle comprises a T-groove which extends in the longitudinal direction of the pin receptacle and into which at least one two-limbed clamping spring, which forms a pencil holder for a drawing pencil and protrudes from a guide plate inserted into the T-groove, for accommodating the drawing pencil is inserted.

To securely receive drawing pencils with the apparatus, at least one groove-shaped pin receptacle is provided between the hypotenuse of the base receptacle and the nearer cover plate, which is designed in such a way that it receives a drawing pencil in a clamping manner on the flank side. One, two or more groove-shaped pin receptacles can be provided, which receive a drawing pencil, in particular a pencil, in a clamping manner. Round, 3-cornered, 6-cornered or arbitrarily profiled drawing pencils are preferably held securely in the receiving space by means of preferably elastic nubs or lips arranged along the longitudinal sides of the pin receptacles between which the drawing pencils can be inserted and projecting towards the receiving space. In this way, drawing pencils can be held in a break-proof manner.

Since drawing pencils are nowadays available on the market in a multitude of different dimensions and with different cross-sections, it is advantageous to take appropriate measures in order to be able to adapt the pencil holder. For this purpose, the pin receptacle comprises a T-groove running in the longitudinal direction of the pin receptacle, into which at least one two-limbed clamping spring forming a holder for a drawing pencil and protruding from a guide plate inserted into the T-groove is inserted to accommodate the drawing pencil. The respective drawing pencil is inserted between the two libs of the clamping spring and held securely by the latter. Two or more holders can be inserted next to each other in the T-groove in the longitudinal direction of the pen receptacle, if necessary interchangeably. The holder can also have a profile length and dimension corresponding to the drawing pencil to be accommodated. The length can preferably be adjusted by a user if necessary.

Above the triangular base receptacle, which has the insertion slot, for the large set square at least one further compartment is thus provided in at least one parallel receiving plane, which is spanned by the cover plate. The cover plate is connected to the base receptacle, in particular formed in one piece with it, while clamping the compartment for additional drawing utensils.

This allows two or more drawing utensils to be securely accommodated in one apparatus. In particular, the additional compartment can form a receptacle for a smaller set square, the triangular cover plate of which is inserted between the catheti of the base receptacle, leaving the insertion opening free.

The insertion slots for the smaller and for the larger set square may be associated with the same or opposite catheti of the base receptacle. In addition, a further additional receptacle forming a receptacle for a rectangular ruler may be provided, wherein the additional receptacle forming a receptacle for a rectangular ruler comprises a cover plate which is arranged plane-parallel to the base receptacle above the base receptacle and whose insertion slot is provided in the region of one of the two catheti of the base receptacle. The insertion slot can also be provided in the region of one of the two catheti of the base receptacle, as in the case of the set squares. Preferably, the one insertion opening for the large set square is associated with one cathete and the insertion openings for the small set square and the ruler are associated with the other, opposite cathete of the apparatus. The cover plates can in turn have insertion openings or the aforementioned openings starting from an insertion opening in order to be able to cleanly grip a respective ruler or set square for removal.

If the plates of the base receptacle or the plate of the base receptacle and the cover plate are spaced apart in such a way that they clamp the set square between them, if necessary with the interposition of a holding element, a secure hold of the drawing utensils in the apparatus is ensured by simple means. Holding means can be, for example, plastic layers, fabric layers or the like, which on the one hand protect the drawing utensils and on the other hand have a corresponding static friction, so that the drawing utensils can only be removed from the apparatus intentionally. Drawing utensils, in particular triangles or rulers, are held in the respective holder by clamping the respective drawing utensil against the upper side and/or against the lower side of the respective holder. The drawing utensil is inserted between the top and bottom of the holder, which may be partially perforated. The openings may allow access to the respective character utensil for removal thereof.

Preferably, a cuboid-shaped receptacle for an eraser can be provided above the base receptacle between two cover plates lying in one plane and laterally next to the insertion opening, wherein at least one wall bounding the receiving compartment comprises clamping knobs possibly projecting into the receiving compartment. In this way, an eraser can also be stored in the apparatus in a simple manner. The receiving compartment for the eraser can comprise clamping knobs projecting from the wall delimiting the receiving compartment, with which the eraser can be clamped in the receiving compartment. The clamping knobs can belong to one or both, in particular opposite, walls which clamp the eraser between them. If the clamping knobs are assigned to two opposite walls of the compartment, it is advisable to offset the clamping knobs of both walls to a gap.

If the apparatus is to be used to transfer a length measurement to a compass by simple means, it is advantageous if the base receptacle, which has a triangular shape, is provided in the region of the hypotenuse with a graduation with scale lines and the scale line of a zero point is provided with a compass attachment point. In particular, the apparatus forms a scaled ruler (30 cm) with an insertion point for a compass. A length measuring instrument is thus provided along the hypotenuse of the apparatus, which has a scale in millimetre steps from zero to 30 cm. The scaling runs from left to right or from right to left, whereby the measuring range starts at the zero point, which has said attachment point for a compass.

The holder is guided in the T-groove so as to be displaceable in the pin-receptacle longitudinal direction, preferably in displacement sections, the displacement sections being bounded by latching elements. This prevents loss of the holders when the drawing pencil is removed and the T-groove is open at the front. However, the T-groove can also be closed at the front with a plug that can be inserted into the T-groove.

Furthermore, a receptacle for a sharpener or the like can be provided between the hypotenuse and the nearer cover plate.

The apparatus makes it possible to securely store and transport the writing and drawing instruments required for teaching in one container, and to remove them easily without having to open lids, flaps, closures, etc. A small and a large set square, a ruler (15 cm), two drawing pencils, an eraser and a drawing pencil sharpener, if necessary with a removable box to which the sharpener is attached, can be securely transported with the apparatus.

Each individual part can be removed or reinserted very easily with 1 hand (or 2 fingers).

The apparatus can have data fields on its front and/or back for labelling, for example a name field, a data field for printing, logo, advertising and the like, and preferably a rewritable timetable on the back.

BRIEF DESCRIPTION OF THE INVENTION

Figure 2:
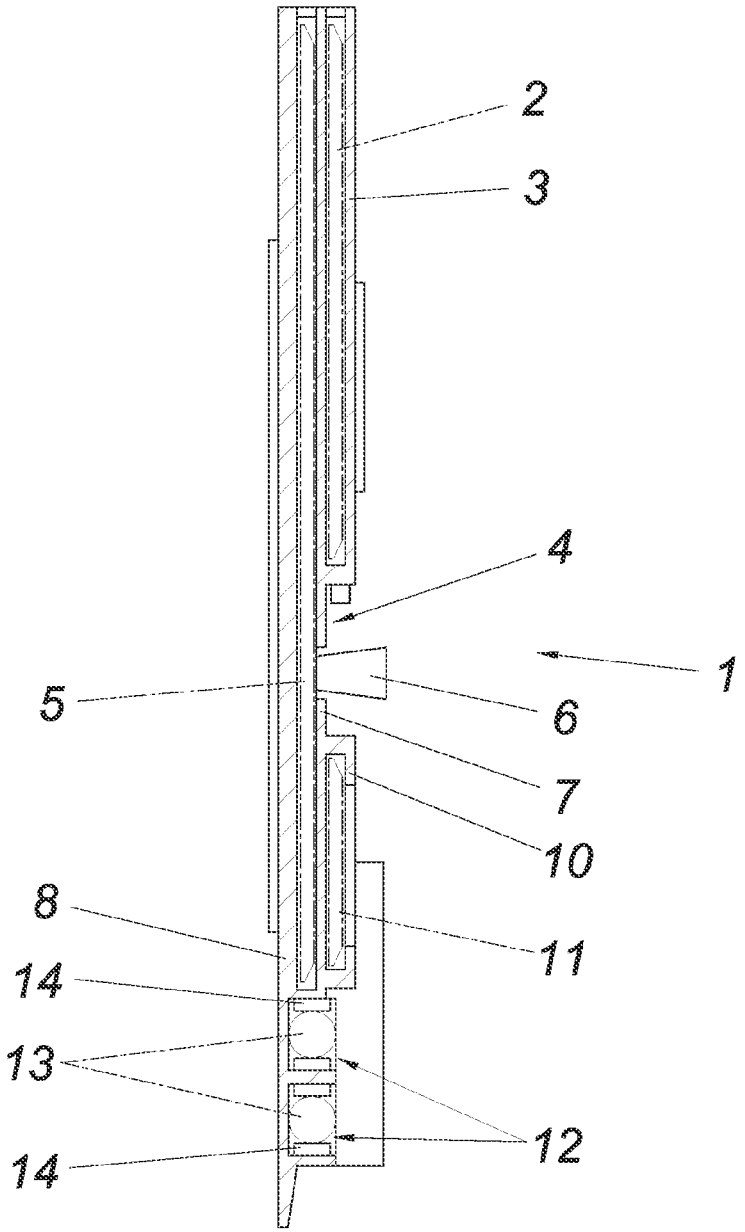
Figure 3:
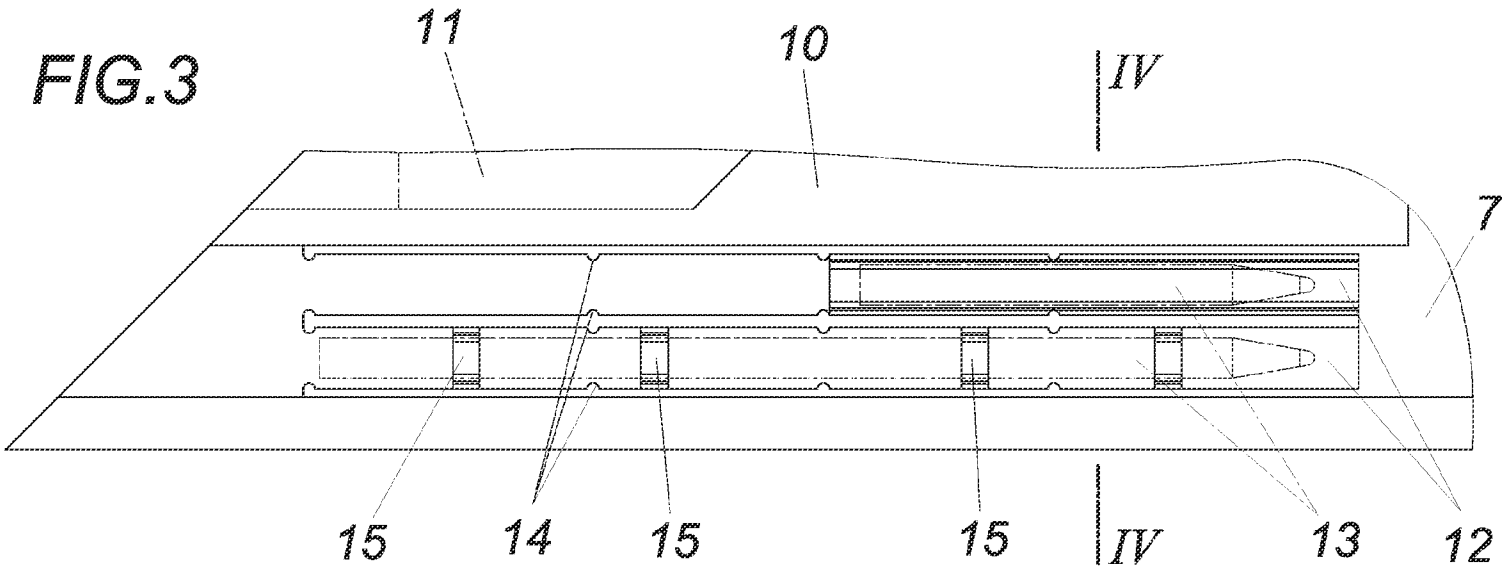
Figure 4:
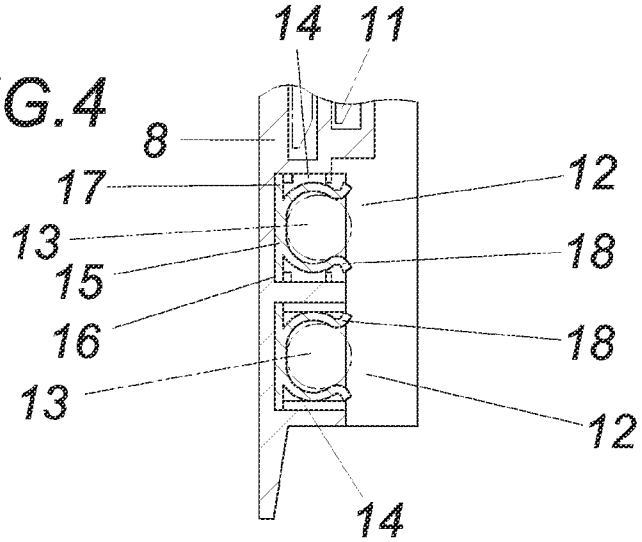

In the drawing, the object of the invention is shown by way of example. It shows FIG. 1 a plan view of an apparatus according to the invention, FIG. 2 the apparatus of FIG. 1 in section according to line II-II, FIG. 3 an enlarged section of FIG. 1 with a preferred pin receptacle, and FIG. 4 the pin receptacle of FIG. 3 in section according to line IV-IV.

WAYS OF CARRYING OUT THE INVENTION

The apparatus 1 for securely accommodating drawing utensils receives a large set square 5 between two plates 7, 8 of a base receptacle 4, the plates 7, 8 being arranged relative to one another and connected to one another in such a way that a compartment for the set square 5 is spanned between them, the compartment having on one side an insertion opening E2 for the set square 5 and, in the plate 7, an insertion slot for a grip piece 6 of the set square 5, the insertion slot originating from the insertion opening E2 and being parallel to the insertion direction. Above the triangular plate 7 of the base receptacle 4 for the large set square 5, which has the insertion slot, at least one further cover plate 3 is arranged which spans an additional compartment for additional drawing utensils, a small set square 2, and which is connected to the base receptacle 4 while spanning the additional compartment. The triangular cover plate 3 of the additional receptacle is inserted between the catheti of the base receptacle 4.

A small set square 2 is inserted into the apparatus 1 at the top left. A lateral insertion slot E1 under the uppermost cover plate 3 enables the set square 2 to be removed with a sliding movement to the left. This uppermost cover plate 3 is arranged at a distance from a base receptacle 4. The receptacle for the small set square 2 is bounded at the bottom by the base receptacle 4 for a large set square 5 and at the top by the uppermost cover plate 3. Along two of the three sides of the cover plate 3, the latter is connected to the base receptacle 4. In the area of the third side there is an insertion slot E1 for the small set square 2.

At the top right is a name field NAME, a printed frame in which a name can be entered with a permanent drawing pencil 13, or in which a name tag can be inserted.

Below this, in the direction of the hypotenuse of the triangular apparatus, in the centre of the apparatus 1, the insertion slot E2 for the grip piece of the large set square 5 can be seen in the base receptacle, which is inserted from the right into the base receptacle 4 of the apparatus. With a sliding movement to the right, the large triangle 5 can be removed with its grip piece 6 or it can be pushed back into the base receptacle 4, which is bounded at the top by the middle plate 7 and at the bottom by a base plate 8. Along two of the three sides, the middle plate 7 and the base plate 8 are connected to each other. In the area of the third side, the insertion slot E2 for the large set square 5 is provided.

In the middle of the apparatus, to the left of the insertion slot E3 or the grip piece 6, an eraser 9 can be clamped between the cover plate 3 of the small set square 2 and a cover plate 10 of a ruler 11 and inserted into a receptacle. Clamping knobs 14 protrude from the cover plate 3 towards the compartment and clamp the eraser 9.

The cover plate 10 of the ruler 11 is provided in the centre, below the receiving compartment, as seen in the direction of the hypotenuse of the apparatus. The ruler 11 is removed or inserted into the apparatus via an insertion slot E3 which is open to the left. With a sliding movement to the left, the ruler 11 can be removed or pushed in again to the right. Along two or three sides of the cover plate 10, the latter is connected to the base receptacle 4. In the area of the fourth, possibly also the third side, an insertion slot is provided for the ruler 11, which could be pushed through its receptacle.

Below this are two groove-shaped pencil holders 12 for drawing pens 13. By tilting the drawing pens 13 as a result of pressing the pencil tip against the middle plate 7, each drawing pencil 13 can be lifted out of the recess. Drawing pencils 13 are held securely in the respective pencil holder 12 by means of preferably resilient nubs 14 arranged along the longitudinal sides of the receptacles between which the drawing pencils 13 can be inserted and projecting towards the receptacle. The drawing pencils 13 can have a thickness, a cross-sectional diameter of 2 to 14 mm.

The pencil holder 12 has a T-groove 16 extending in the longitudinal direction of the pencil holder, into which at least one two-limbed clamping spring 18 forming a holder 15 for a drawing pencil 13 and projecting from a guide plate 17 inserted into the T-groove 16 is inserted to receive the drawing pencil 13. The holders 15 are guided in the T-groove 16 so as to be displaceable in the longitudinal direction of the pen receptacle in displacement sections, the displacement sections being bounded by latching elements, the clamping knobs 14.

To the right of this is a receptacle 19 for a pencil sharpener 20 (FIG. 1). A container 21 is inserted into the holder, which carries the pencil sharpener 20 on the inside of the container at the front. This allows a drawing pencil 13 to be sharpened when the container 21 is inserted into the receptacle 19 and the sharpening waste is stored in the container until it is disposed of.

A ruler scale from 0 to 30 cm is attached (printed) at the lower end in the area of the hypotenuse of the apparatus. Graduated in mm-steps, each cm-point is provided with a digit. Thus, a full-fledged "ruler" exists here. The scale line assigned to the 0 point of the scale is equipped with an attachment point 0 for a compass.

The invention claimed is:

1. An apparatus for securely accommodating drawing utensils, said apparatus comprising:

a base receptacle that receives a set square between two plates thereof, wherein the plates are arranged relative to one another and connected to one another so as to define a compartment for the set square between them, wherein the compartment has an insertion opening on one side thereof receiving the set square in an insertion direction, and, in one of the plates, an insertion slot for a grip piece of the set square, said insertion slot originating from the insertion opening and being parallel to the insertion direction, and wherein, said one of the plates is triangular, and, at least one additional cover plate is arranged above the triangular plate, spanning an additional compartment for drawing utensils, wherein the additional which cover plate is connected to the base receptacle while spanning the additional compartment, and wherein at least one groove-shaped pin receptacle is provided between a hypotenuse of the base receptacle and a nearer cover plate, wherein said pin receptacle is configured to accommodate a drawing pencil in a clamping manner on a flank side, and wherein the pin receptacle comprises a T-groove that extends in a longitudinal direction of the pin receptacle and into which at least one two-limbed clamping spring is inserted, wherein said clamping spring forms a pencil holder for the drawing pencil and protrudes from a guide plate inserted into the T-groove, so as to accommodate the drawing pencil.

2. The apparatus according to claim 1, wherein an additional receptacle forms a receptacle for a second set square smaller than the first set square, the additional receptacle having a triangular cover plate inserted between catheti of the base receptacle.

3. The apparatus according to claim 1, wherein an additional receptacle forms a receptacle for a rectangular ruler, the additional receptacle having a cover plate arranged above the base receptacle and an insertion slot in a region of one of two catheti of the base receptacle.

4. The apparatus according to claim 1, wherein the plates of the base receptacle are spaced apart from one another so as to accommodate a character triangle between them in a clamping manner.

5. The apparatus according to claim 2, wherein the plate of the base receptacle and the cover plate are spaced apart from one another so as to accommodate the small set square between them in a clamping manner.

6. The apparatus according to claim 1, wherein a cuboid-shaped receiving compartment for an eraser is provided above the base receptacle between two cover plates lying in one plane, wherein at least one wall bounding the receiving compartment comprises clamping knobs projecting into the receiving compartment.

7. The apparatus according to claim 1, wherein the base receptacle has a triangular shape, is provided in a region of the hypotenuse with a graduation with scale lines, and the scale line of a zero point is provided with a compass attachment point.

8. The apparatus according to claim 1, wherein the pencil holder is guided displaceably in the T-groove in the longitudinal direction of the pencil holder in displacement sections, wherein the displacement sections are bounded by latching elements.

9. The apparatus according to claim 2, wherein a further additional receptacle forms a receptacle for a rectangular ruler, the further additional receptacle having a respective cover plate arranged above the base receptacle and an insertion slot in a region of one of two catheti of the base receptacle.

10. The apparatus according to claim 4, wherein the plates of the base receptacle are spaced apart from one another so as to accommodate the character triangle between them in a clamping manner with the interposition of a retaining element.

11. The apparatus according to claim 5, wherein the plate of the base receptacle and the cover plate accommodate the small set square between them in the clamping manner with the interposition of a retaining element.

12. The apparatus according to claim 3, wherein the plate of the base receptacle and the cover plate are spaced apart from one another so as to accommodate the ruler between them in a clamping manner.

13. The apparatus according to claim 11, wherein the plate of the base receptacle and the cover plate accommodate the ruler between them in the clamping manner with the interposition of a retaining element.

* * * * *